United States Patent [19]

Berzin

[11] Patent Number: 4,721,157

[45] Date of Patent: Jan. 26, 1988

[54] FLUID SAMPLING APPARATUS

[75] Inventor: Vel Berzin, Houston, Tex.

[73] Assignee: Baker Oil Tools, Inc., Orange, Calif.

[21] Appl. No.: 862,491

[22] Filed: May 12, 1986

[51] Int. Cl.[4] ..... E21B 49/08

[52] U.S. Cl. ..... 166/169; 166/264

[58] Field of Search ..... 166/169, 264, 164, 167

[56] References Cited

U.S. PATENT DOCUMENTS

| | | | |
|---|---|---|---|
| 4,372,382 | 2/1983 | Rooney et al. | 166/264 |
| 4,412,584 | 11/1983 | Brandell | 166/169 |
| 4,502,537 | 3/1985 | Carter, Jr. | 166/167 X |
| 4,597,439 | 7/1986 | Meek | 166/264 X |

*Primary Examiner*—George A. Suchfield

*Attorney, Agent, or Firm*—Norvell & Associates

[57] ABSTRACT

An apparatus for extracting a virgin fluid sample from a selected formation of subterranean well comprises an outer tubular housing disposed between two packing elements straddling the selected formation and having radial ports communicating with the annulus adjacent the selected formation. A hollow mandrel extends entirely through the length of the tubular housing, and the lower portions of such mandrel cooperate with the bore of the internal tubular housing to define a sample-collecting chamber. Fluid passage from the radial ports to the collecting chamber are blocked in the run-in position of the apparatus by an axially shiftable valve sleeve, which is shear pinned in a flow-blocking position during run-in of the tool. Fluid pressure is then applied to the bore of the hollow mandrel to shift the valve sleeve upwardly and remove the valve sleeve from its flow-blocking position, thereby permitting flow from the radial ports into the sampling chamber. After a sufficient sample has been collected, further upward movement of the valve sleeve produced by a higher fluid pressure in the mandrel bore shifts the valve sleeve to a second position wherein a second set of seals block the communication between the radial ports and the fluid-collecting chamber and effectively isolates the collecting chamber for withdrawal from the well.

16 Claims, 11 Drawing Figures

FLUID SAMPLING APPARATUS

BACKGROUND OF THE INVENTION

1. Field of the Invention:

The invention relates to an apparatus for extracting fluid samples from a selected formation of a subterranean well, and particularly to an apparatus for extracting virgin fluid from the selected formation and transferring such fluid to the well surface without contamination.

2. History of the Prior Art:

It has long been the practice in the drilling of subterranean wells to extract fluid samples from various formations traversed by the well as the drilling proceeds. Fluid samples from any particular selected formation taken under these circumstances is subject to a high degree of contamination by drilling fluid which necessarily has to be present in the well. Accordingly, the prior art apparatus for extracting fluid samples from a selected formation have not been constructed in such manner as to obtain an uncontaminated virgin sample of the fluid actually existing in the formation. When, however, the drilling of the well is substantially completed, and all of the drilling mud has been flushed out of the well bore, the opportunity is present for obtaining a virgin fluid sample from a selected formation in the well. Such sample must be isolated from any contamination by well fluids existing in the annulus above or below the selected formation and from any fluids employed in the operation of the sampling apparatus. Prior art apparatus have not met this criteria.

SUMMARY OF THE INVENTION

The invention provides an apparatus for extracting a virgin fluid sample from a selected formation traversed by a subterranean well. The sampling apparatus is operatively connected between two packing elements which, if the well is uncased, preferably comprise inflatable packers. Such packers are axially spaced by a distance corresponding to the desired height of the selected formation and, when lowered into the well respectively adjacent the top and bottom ends of the selected formation and expanded into sealing engagement with the well bore, effectively isolate the selected formation from the remainder of the well.

An outer tubular housing is provided with one or more radial ports which provide communication with the annulus defined between the walls of the selected well formation and the exterior of the outer tubular housing. An inner tubular assembly is mounted within the outer tubular housing, being secured at its upper end to the outer tubular housing by a connecting sub and extending downwardly to a point beyond the radial sampling port. The inner tubular housing defines a cylindrical bore within which a hollow mandrel is slidably and sealably mounted. The hollow mandrel connects at its upper end with a tubing string extending to the well surface so that fluid pressure may be applied to the interior of the hollow mandrel.

The hollow mandrel is at least the same length as the outer tubular housing, and the annular space between the hollow mandrel and the bore of the outer tubular housing defines a collection chamber. Such chamber is closed at its lower end by a bushing which is sealably secured to the outer tubular housing and slidably and sealably engagable with the exterior of the hollow tubular mandrel.

Communication between the radial sampling ports and the upper end of the sampling chamber is controlled by the position of a sleeve valve which is mounted in the annulus defined between the bore of the outer tubular housing and the external surface of the inner tubular assembly. In the run-in position of the apparatus, a first sealing means on the valve sleeve blocks communication between the radial sampling port and the sampling chamber. The valve sleeve is retained in this blocking position by a shear pin which may be secured to either the outer tubular housing or the inner housing assembly.

The internal bore of the valve sleeve cooperates with the exterior of the hollow mandrel to define a fluid pressure chamber. A radial port is provided in the hollow mandrel which, in the run-in position of the apparatus, is straddled by two seal elements respectively provided on the inner tubular assembly and the connecting sub so that fluid pressure within the hollow mandrel cannot be applied to the fluid pressure chamber in the run-in position.

After the apparatus is properly located in the well and the packing elements expanded into sealing engagement with the well bore, the mandrel is shifted downwardly to bring the aforementioned mandrel port into fluid communication with the fluid pressure chamber. The fluid pressure within the bore of the hollow mandrel is increased to cause an upward displacement of the valve sleeve after shearing of the shear pin. Such upward displacement is limited by a stop ring which is shearably secured to the interior of the outer tubular housing. In this position, the first sealing means on the valve sleeve, which previously blocked communication between the sampling ports and the sampling chamber, is moved to a position above the sampling ports and virgin fluid from the selected formation can flow freely into the sampling chamber which, of course, is maintained at either atmospheric or subatmospheric pressure during the well insertion procedure.

After the passage of sufficient time to ensure that a good quantity of virgin fluid has flowed into the sampling chamber, the fluid pressure within the hollow mandrel is further increased and this causes a shearing of the stop ring and permits the valve sleeve to move to a second position wherein a second sealing means on the valve sleeve blocks communication between the sampling ports and the top end of the sampling chamber. A unidirectional ratcheting mechanism is provided between the valve sleeve and the inner tubular housing to prevent return movement of the valve sleeve from either its first or second position. Accordingly, the apparatus can now be removed from the well with the fluid sample being completely enclosed and isolated within the fluid sampling chamber.

At the well surface, the virgin fluid sample is removed through a discharge passage provided in the bushing that closes the bottom end of the sampling chamber. A discharge passage in the bushing is threaded at its outlet end to receive the threaded neck of a fluid sample bottle and a manually operated valve, which is normally closed, is disposed in such passageway. Opening of the valve will permit the virgin fluid sample to flow by gravity into the collecting bottle without any risk of contamination.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
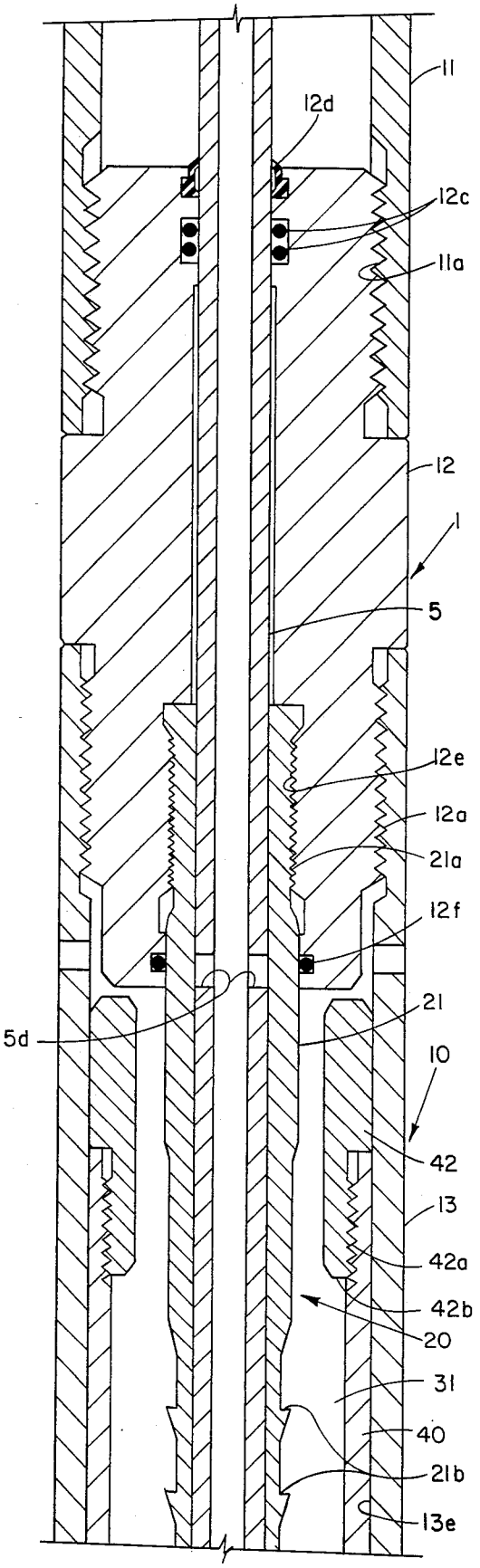
FIGS. 1A, 1B, 1C, and 1D collectively constitute a vertical sectional view of a sampling apparatus embodying this invention, with the elements thereof shown in the run-in position.
Figure 1B:
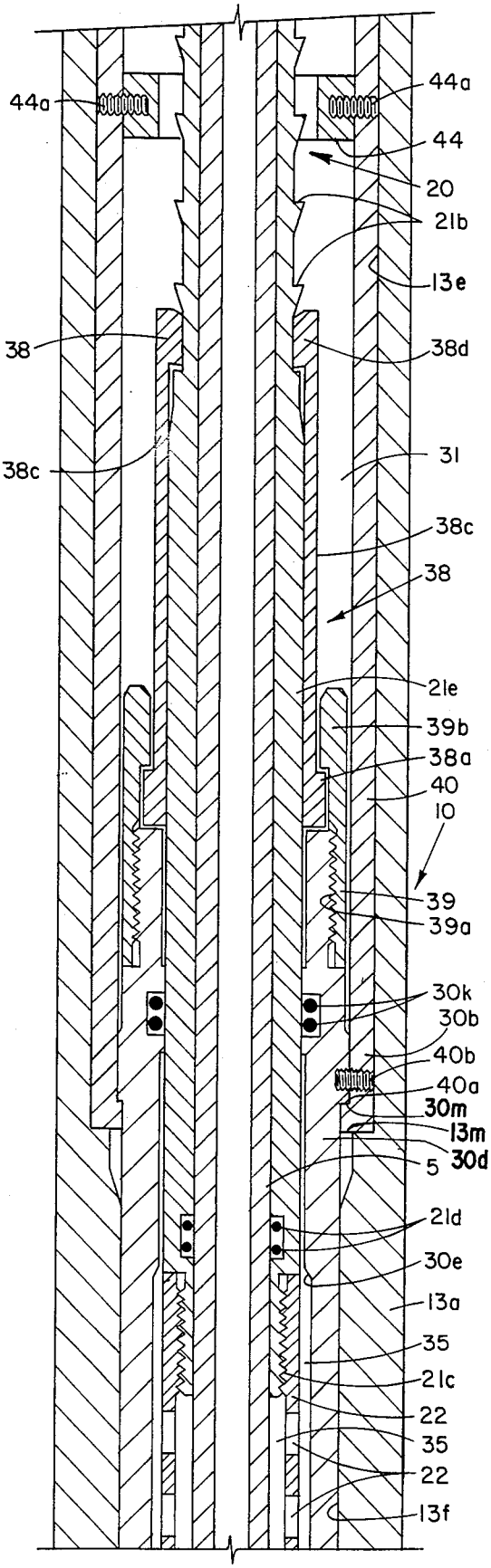
Figure 1C:
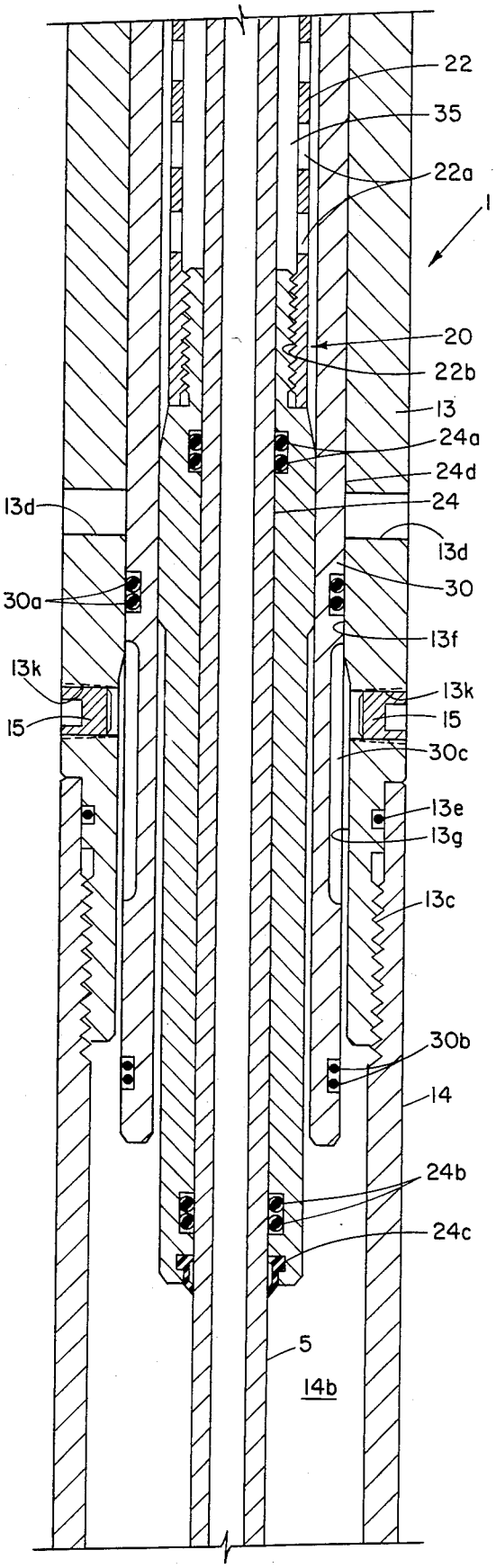
Figure 1D:
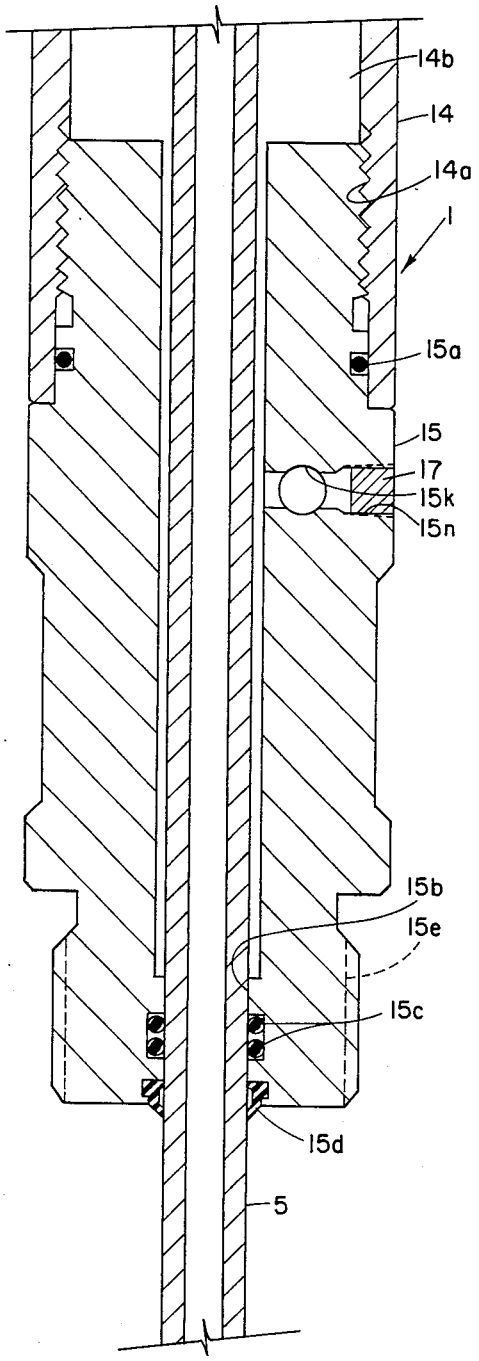

Referring to FIGS. 1A-1C, a well fluid-sampling apparatus 1 embodying this invention comprises an outer tubular housing 10 which is conventionally mounted between two retrievable packers (not shown), thus disposing the fluid sampling apparatus adjacent to a selected isolated zone of the well from which a fluid sample is to be extracted. A hollow mandrel 5 extends downwardly through the outer tubular housing 10 and is conventionally connected at its upper end to a tubing string so that axial movement of the mandrel 5 relative to the outer tubular housing 10 may be conveniently effected.

Outer tubular housing 10 comprises an upper tubing portion 11 connectable to an upper packer and having its lower end connected by internal threads 11*a* to an upper connecting sub 12. Upper sub 12 mounts internal O-rings 12*c* and a wiping seal 12*d* which engage hollow mandrel 5. Upper connecting sub 12 is provided with external threads 12*a* on its lower end which are threadably secured to the upper end of an elongated sleeve portion 13. Sleeve portion 13 has a radially inwardly thickened portion 13*a* at its lower end defining an upwardly facing shoulder 13*m*. The radially thickened portion 13*a* terminates in external threads 13*c* which are sealed by an O-ring 13*e* and engaged with the top end of a lower sleeve portion 14. The lower end of the lower sleeve portion 14 is provided with internal threads 14*a* which are secured to the top end of a sample dispensing sub 15. Threads 14*a* are sealed by an O-ring 15*a*. The extreme bottom end of dispensing sub 15 has an internally projecting portion 15*b* in which are mounted O-rings 15*c* and a wiper seal 15*d*, both of which cooperate with the external surface of the hollow mandrel 5. Thus an annular sample fluid-collecting chamber 14*b* is defined above sample dispensing sub 15.

The hollow mandrel 5 may extend downwardly to another tool, if desired, and external threads 15*e* are provided on the bottom end of the dispensing sub 15 permit the connection thereof to the lower packer. Normally, the bore 5*a* of the hollow mandrel 5 is provided with a conventional removable plug (not shown) so that fluid pressure can be built up within the bore 5*a* of the hollow mandrel 5.

An inner housing assembly 20 is fixedly mounted within the annulus 31 defined between the internal bore surface 13*f* of the sleeve portion 13 of the outer tubular housing 10 and the exterior of hollow mandrel 5. Inner tubular housing 20 comprises at its upper end a ratcheting sleeve 21 having external threads 21*a* formed thereon which cooperate with corresponding threads formed in a counterbore 12*e* formed in the bottom end of the upper connecting sub 12. An O-ring 12*f* seals the threads 21*a*. The lower portion of ratchet sleeve 21 is provided with axially spaced ratchet teeth 21*b* for a purpose to be hereinafter described. The bottom end of ratchet sleeve 21 terminates in an externally threaded, reduced-diameter portion 21*c* which is threadably engaged with the upper end of a perforated sleeve 22. Additionally, the lower end of ratchet sleeve 21 is provided with a pair of O-rings 21*d* sealably engaging the exterior of hollow mandrel 5.

Perforated sleeve 22 is provided with a plurality of peripherally and axially spaced perforations 22*a* and terminates at its lower end with internal threads 22*b* which are threadably engaged with the upper end of a sealing sleeve 24. Sealing sleeve 24 has two sets of axially spaced internal O-rings 24*a* and 24*b* and, at its bottom end, a wiper seal 24*c* engaging the outer periphery of the hollow mandrel 5. Additionally, the sealing sleeve 24 has an external bearing surface 24*d* which provides bearing support for a piston-type sleeve valve 30 which is mounted in the annulus defined between the outer tubular housing 10 and the inner tubular housing 20.

The piston-type sleeve valve assembly 30 comprises a lower sleeve portion having vertically spaced pairs of external O-ring seals 30*a* and 30*b*. In the run-in position of the apparatus, only the upper O-rings 30*a* are engaged with the internal bore surface 13*f* of the sleeve element 13 of the outer tubular housing 10. Immediately below the run-in position of the O-ring seals 30*a*, the outer sleeve portion 13 has a slightly enlarged-diameter counterbore 13*g* extending to the bottom end of the sleeve portion 13. Intermediate the O-ring seals 30*a* and 30*b*, the piston-type valve sleeve 30 is provided with an annular recess 30*c* for a purpose to be hereinafter described.

Immediately above the O-rings 30*a*, the sleeve portion 13 of the outer tubular housing 10 is provided with one or more radial ports 13*d*, and it is through these ports that the formation fluid to be sampled flows into the annular fluid-collecting chamber 14*b* when the piston-type valve sleeve 30 is shifted upwardly relative to the outer tubular housing 10.

The top end portion 30*d* of the piston-type valve sleeve 30 is of increased internal thickness as indicated at 30*d*, thus defining a downwardly facing shoulder 30*e* which functions as a piston to effect the movement of the piston-type valve sleeve 30. Additionally, the top end portion 30*d* mounts a pair of internal O-rings 30*k* which sealably engage the bottom sleeve portion 21*e* of the ratcheting sleeve 21.

From the foregoing description, it is apparent that an annular fluid pressure chamber 35 is defined intermediate the internal bore of the outer tubular housing 10 and the external surface of the hollow mandrel 5 and that the piston-type valve sleeve 30 is slidably and sealably mounted in the annular fluid pressure chamber. In the run-in position of the apparatus, an external shoulder 30*m* on the piston-type valve sleeve 30 abuts an upwardly facing internal shoulder 40*a* formed on the bottom end of a positioning sleeve 40. Sleeve 40 is additionally secured to the piston-type valve sleeve 30 by one or more shear screws 40b. The upper end of the positioning sleeve 40 is provided with a stop sleeve 42 (FIG. 1A) by a threaded connection 42a. Additionally, a stop ring 44 is shearably secured to the interior of the stop sleeve 40 by one or more shear screws 44a. The bottom of stop sleeve 40 abuts shoulder 13m on sleeve portion 13a.

A unidirectional latching collet 38 is secured to the top end of the piston-type valve sleeve 30 by a connection sleeve 39 having internal threads 39a engaging external threads on the extreme top end of the piston-type valve sleeve 30. Latching collet 38 has a solid ring portion 38a which is trapped by the inwardly enlarged head portion 39b of the retaining sleeve 39, and upwardly extending, inwardly biased resilient arms 38c terminating in inwardly enlarged head portions 38d which are contoured to effect a unidirectional ratcheting connection with the ratchet teeth 21b provided on the inner housing assembly 20. Thus, only movement of the piston-type valve sleeve 30 in an upward direction is permitted by the ratchet teeth 21a which prevent the valve sleeve 30 from returning to its original position after it has once moved upwardly away from such position.

One or more radial ports 5d are provided in the wall of the hollow mandrel 5 at a position intermediate the internal O-ring seals 12c provided in the connecting sub 12 and the internal O-ring seals 21d provided in the lower portion of the ratcheting sleeve 21 when the mandrel 5 is in its run-in position with respect to the outer tubular housing 10. Suitable shear screws (not shown) secure mandrel 5 in said run-in position.

Figure 2B:
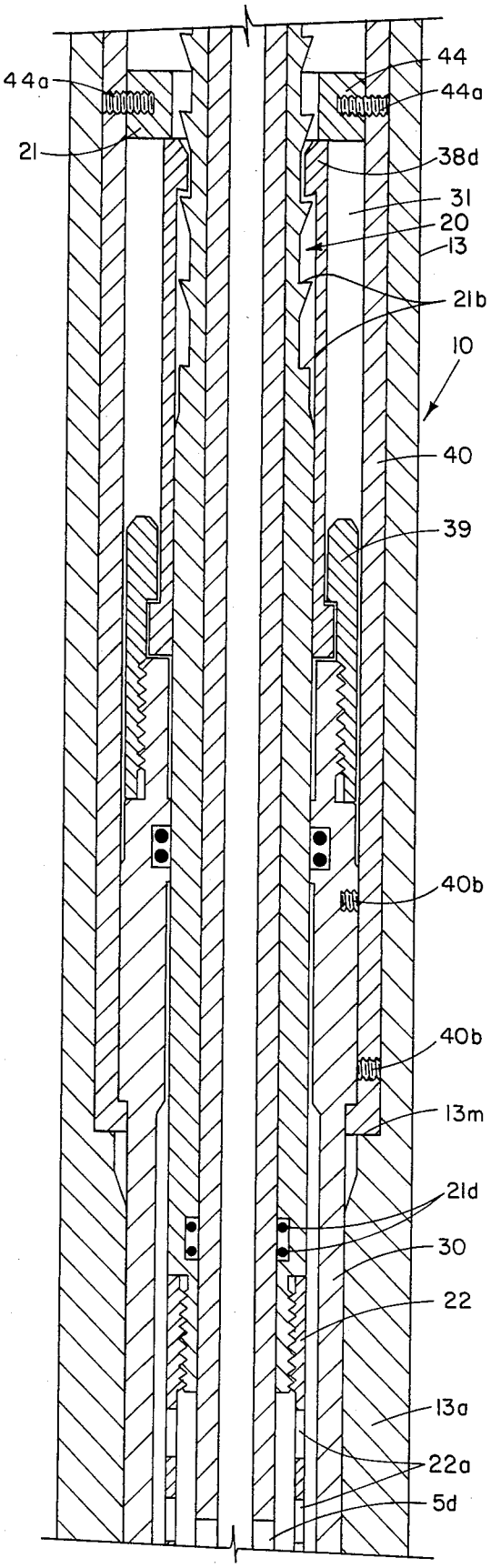
FIGS. 2B and 2C respectively correspond to FIGS. 1B and 1C, but show the elements of the sampling apparatus in the position permitting a flow of well fluid into the sampling chamber.
Figure 2C:
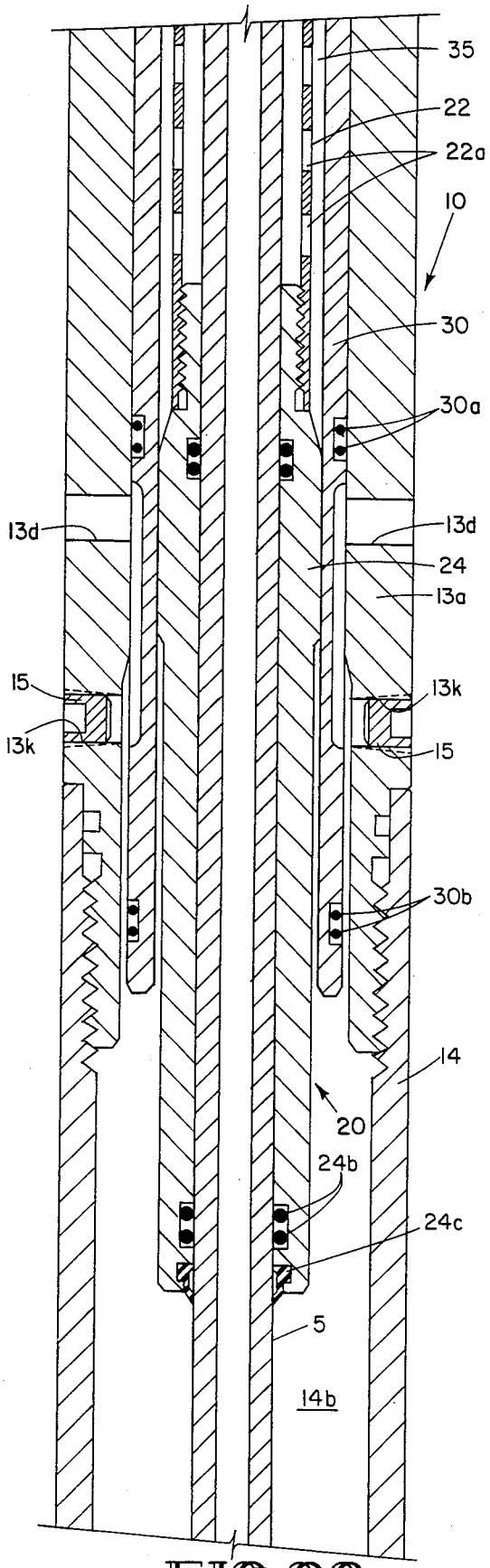

To effect the collection of fluid samples from a well zone opposite the sampling ports 13d, a downward force is applied to the mandrel 5 to shear the shear screws. The hollow mandrel 5 is then moved downwardly with respect to the outer tubular housing 10 until the mandrel ports 5d are brought into general alignment with the perforated sleeve 22. Fluid pressure is then applied to the bore of the hollow mandrel 5 through the tubing string and such fluid pressure flows into the fluid pressure chamber 35, thereby exerting an upward force on the piston-type sleeve valve 30. Such fluid pressure is increased until the shear screws 40b shear, following which the piston-type sleeve valve 30 moves upwardly until the enlarged head portions 38d of the collet 38 engage the stop ring 44. In this position, illustrated in FIGS. 2B–2C, the seals 30a, which have previously blocked fluid flow through the sampling ports 13d, are moved to a position above the sampling ports 13d. Fluid flow into the sampling chamber 14b can then readily occur, aided by the annular recess 30c provided on the piston-type sleeve valve 30. The fluid flowing into the sampling chamber 14b is not exposed to contamination by other well fluids or by the fluid utilized to actuate the piston-type sleeve valve 30.

Figure 3A:
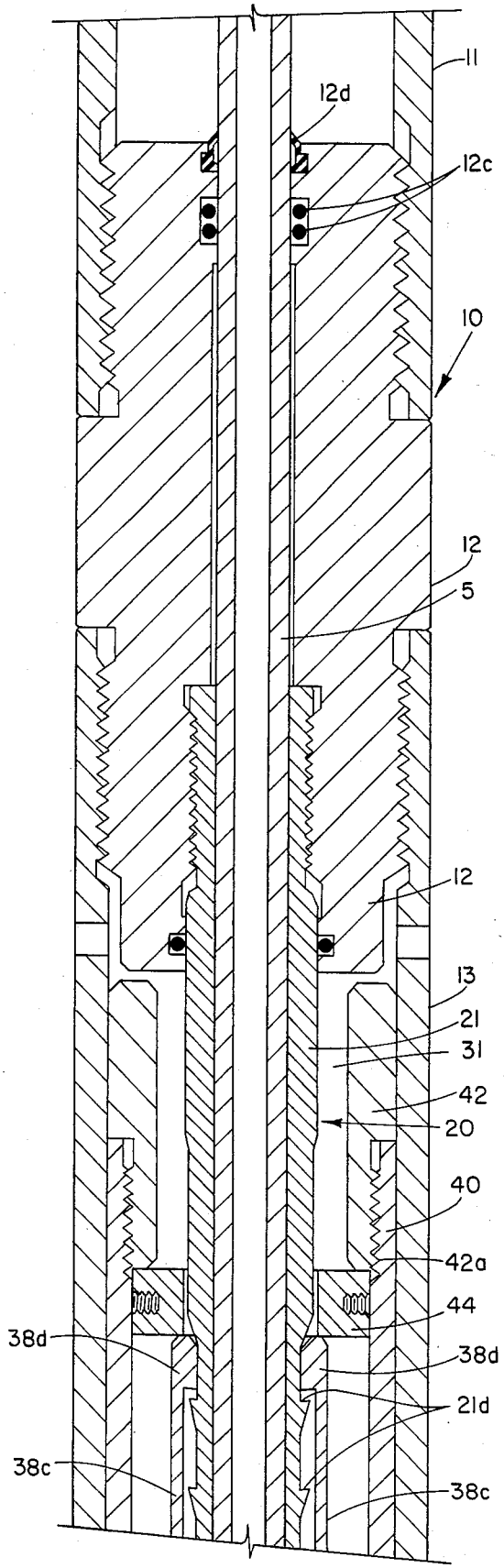
FIGS. 3A, 3B,and 3C respectively correspond to FIGS. 1A, 1B, and 1C, but with the elements thereof shown in the position for withdrawal of the sampling apparatus from the well.
Figure 3B:
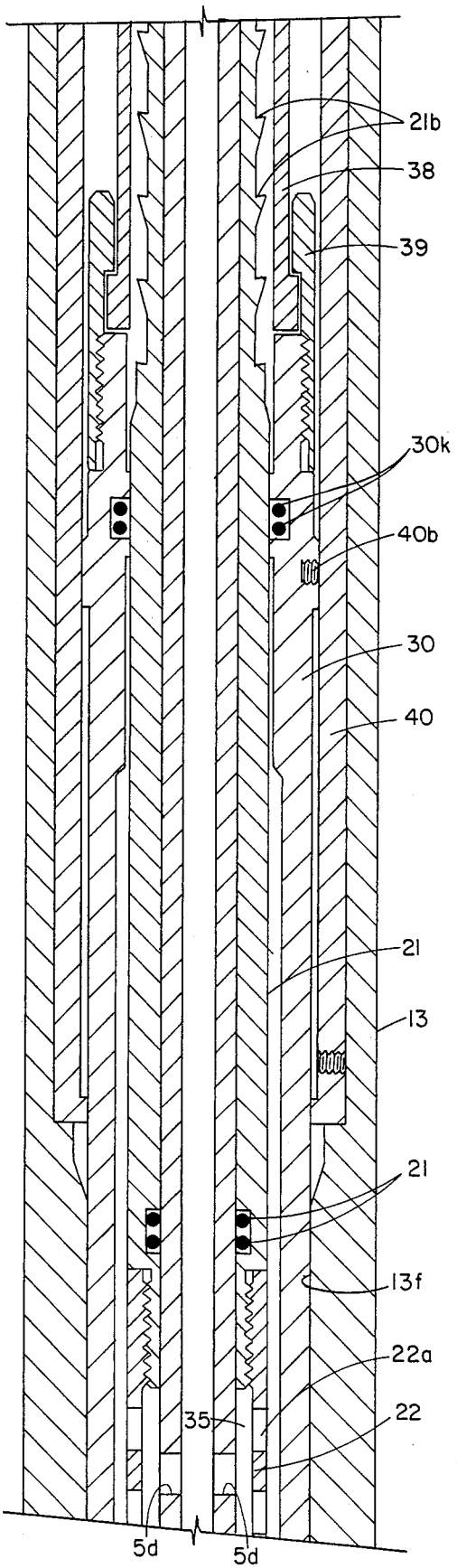

When a sufficient quantity of sampling fluid has been collected, the fluid pressure within the bore 5a of the hollow mandrel 5 is increased to a still higher level which effects the shearing of the shear screws 44a holding the stop ring 44 in position, and the piston-type sleeve valve 30 is permitted to move to its extreme upward position as illustrated in FIGS. 3A and 3B, wherein the stop ring 44 abuts the lower end of the stop sleeve 42, as shown in FIG. 3A. In this position, the lower set of O-ring seals 30b provided on the bottom end of piston-type sleeve valve 30 are in sealing engagement with the internal bore surface 13f of the outer tubular housing 13 and, thus, blocks fluid passage from the sampling ports 13d into the sampling chamber 14b. At the same time, the contents of sampling chamber 14b are isolated from contact by any other fluids.

Those skilled in the art will recognize that the sampling chamber 14b may be maintained at atmospheric pressure as the apparatus is lowered into position in the well or a vacuum may be maintained in the sampling chamber 14d. Alternatively, the sampling chamber may contain a chemical treatment fluid to react with the fluid extracted from the isolated zone of the well. For this purpose, one or more radial ports 13k are provided in the wall of the sleeve portion 13a of the outer tubular housing 10 for filling or draining of the sampling chamber 14b. The ports 13k are sealed by a plug 15 during the operation of the apparatus in the well.

Figure 3C:
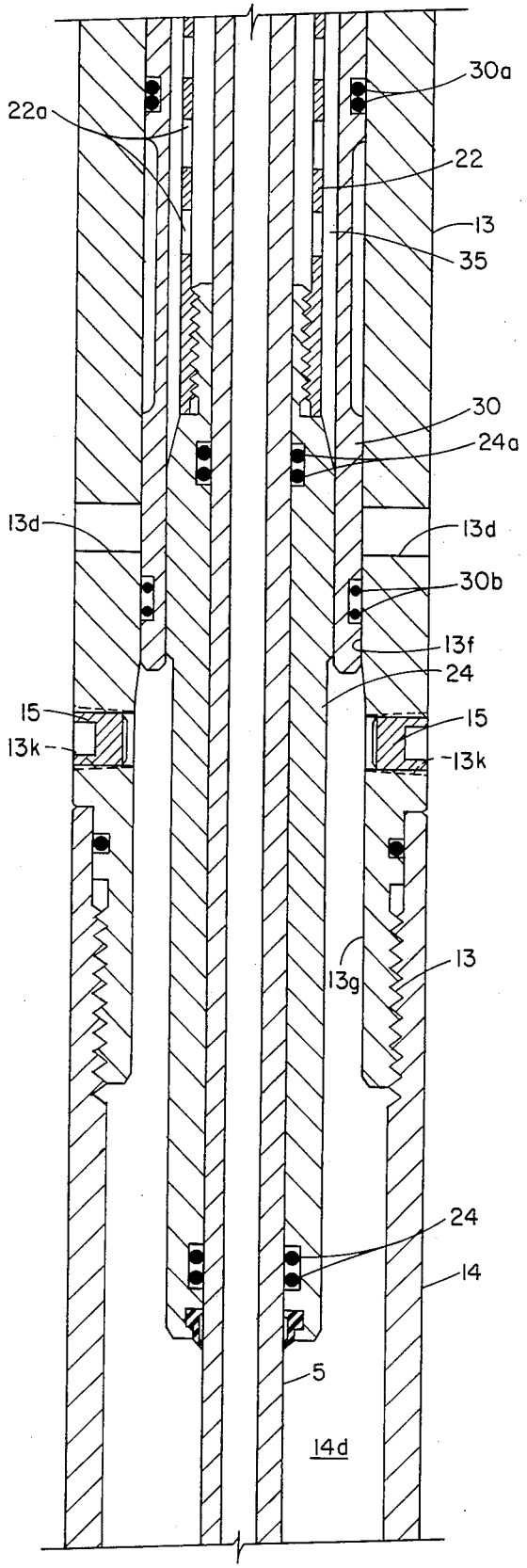
Figure 4:
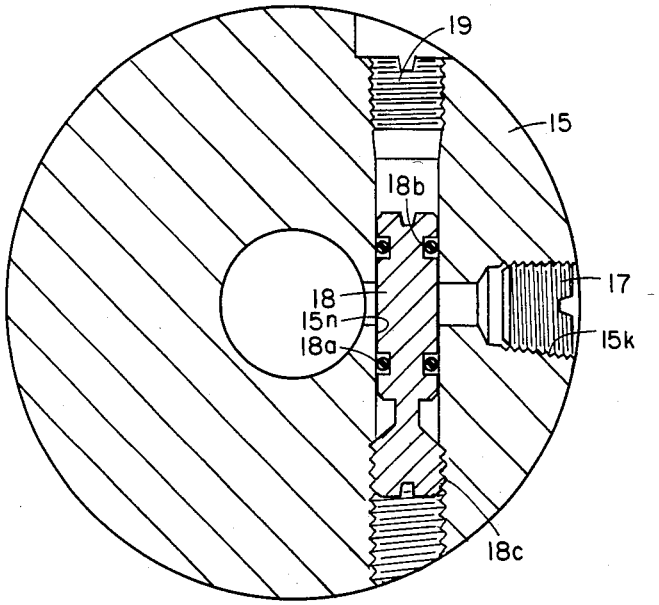
FIG. 4 is sectional view taken on the plane 4—4 of FIG. 1D.
Figure 5:
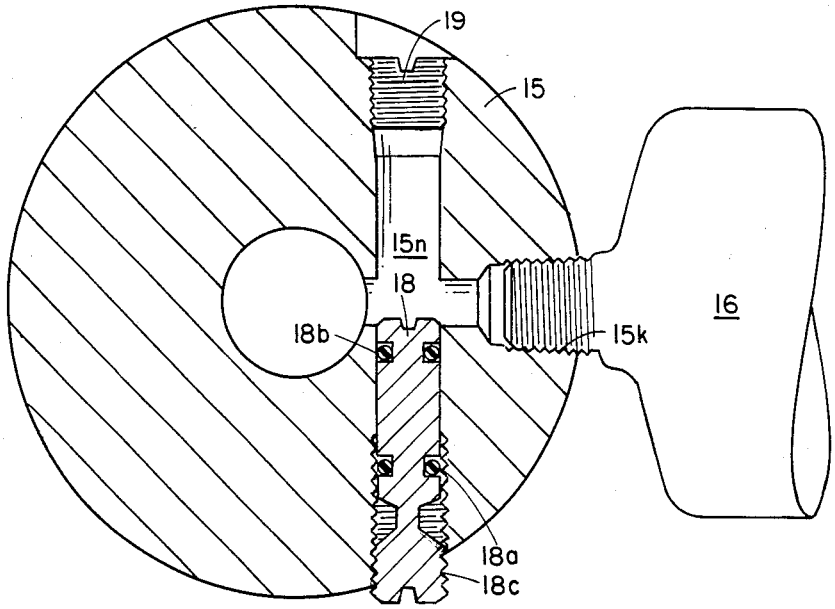
FIG. 5 is a figure similar to FIG. 4, but illustrating the attachment of a sample bottle to the apparatus after removal from the well.

Once the piston-type sleeve valve 30 is moved to its uppermost position, illustrated in FIGS. 3A–3C, the entire apparatus may be removed from the well with the sampling chamber 14b and the well fluid contained therein isolated from contact with any other fluids. Upon reaching the surface, it is convenient to remove the trapped sample of fluid from the fluid chamber 14b through the bottom of such chamber defined by fluid dispensing sub 15. For this purpose, sub 15 is provided with a radial fluid removal port 15k which has internal threads 15 m at its outer end to accommodate a plug 17 while the apparatus is in the well, and the threaded neck of a sample-receiving container 16 (FIG. 5) when the apparatus is at the surface. The radial port 15k is normally closed by a manually operable plug valve 18 which is mounted in a transverse bore 15n which intersects the sample outlet port 15k. Plug valve 18 is provided with a pair of external seals 18a and 18b which bracket the outlet port 15k. Additionally, plug 18 is provided with external threads 18c by which the plug can be threadably removed from the bore 15n and thus open the removal port 15k. A plug 19 is inserted in the other end of the bore 15n to prevent loss of fluid through that end of the bore 15n as the plug valve 18 is shifted to its open position.

Accordingly, those skilled in the art will recognize that the aforedescribed apparatus provides a simple, economical structure for effecting the removal of virgin fluid from a selected isolated zone of a well by entrapping such virgin fluid within a sampling chamber and effecting the removal of the virgin fluid from the sampling chamber without contamination by any other fluid. Thus, an accurate appraisal of the fluid contents of any selected zone of a subterranean well can be accomplished.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for extracting virgin fluid from a selected formation of a subterranean well isolated by a pair of vertically spaced packing units, comprising: an outer tubular housing sealably connectable between said packing units to lie adjacent to the selected formation; at least one radial port in the wall of said outer tubular housing communicating with the well annulus between said outer tubular housing and the selected formation; a hollow mandrel slidably mounted within said tubular outer housing and defining an isolated annular sampling chamber in the annulus between said hollow mandrel and the bore of said outer tubular housing; the bore of said hollow mandrel being communicable with a surface source of fluid pressure; a valve sleeve shiftably mounted within said annulus adjacent said radial port; first sealing means on the exterior of said valve sleeve preventing communication between said radial port and said sampling chamber in the run-in position of said apparatus; means responsive to a first fluid pressure in said hollow mandrel for axially shifting said valve sleeve from said run-in position to a first position to open communication between said radial port and said sampling chamber; thereby permitting flow of virgin fluid from the selected formation into said sampling chamber; second sealing means on said valve sleeve operative in a second axial position of said valve sleeve to block communication between said radial port and said sampling chamber; and means responsive to a second higher fluid pressure in said hollow mandrel bore for further shifting said valve sleeve to said second position.

2. The apparatus of claim 1 further comprising shearable means for securing said valve sleeve in said run-in position.

3. The apparatus of claim 1 further comprising unidirectional ratcheting means for preventing return movement of said valve sleeve from said first and second positions.

4. The apparatus of claim 1 wherein said means responsive to fluid pressure in said mandrel bore comprises a fluid pressure chamber defined between said valve sleeve bore and the exterior of said mandrel; an internal piston shoulder on said valve sleeve bore; and a radial port in said hollow mandrel communicable with said fluid pressure chamber.

5. The apparatus of claim 4 further comprising fixed sealing means isolating said mandrel radial port from said fluid pressure chamber in the said run-in position of the apparatus, whereby axial movement of said hollow mandrel from said run-in position is required to establish communication between said mandrel radial port and said fluid pressure chamber.

6. Apparatus for extracting virgin fluid from a selected formation of a subterranean well isolated by a pair of vertically spaced packing units, comprising: an outer tubular housing sealably connectable between said packing units to lie adjacent to the selected formation; at least one radial port in the wall of said outer housing communicating with the well annulus between said outer tubular housing and the selected formation; an inner tubular assembly connected at its upper end to said outer tubular housing and having a lower end terminating below and adjacent to said radial port and defining an annular space intermediate the exterior of said tubular assembly and the bore of said outer tubular housing; a hollow mandrel connectable at its upper end to a tubing string and having a lower end extending beyond the lower end of said outer tubular housing; said hollow mandrel being slidably and sealably mounted in the bore of said inner tubular assembly; the lower portion of said outer tubular housing defining an isolated annular sampling chamber in the annulus between the bore of said outer tubular housing and the exterior of said hollow mandrel; a valve sleeve shiftably mounted within said annular space and adjacent said radial port; first sealing means on the exterior of said valve sleeve preventing communication between said radial port and said sampling chamber in the run-in position of said apparatus; means responsive to a first fluid pressure in said hollow mandrel for axially shifting said valve sleeve from said run-in position to a first position to open communication between said radial port and said sampling chamber; thereby permitting flow of virgin fluid from the selected formation into said sampling chamber; second sealing means on said valve sleeve operative in a second axial position of said valve sleeve to block communication between said radial port and said sampling chamber; and means responsive to a second higher fluid pressure in said hollow mandrel bore, for further shifting said valve sleeve to said second position.

7. The apparatus of claim 6 further comprising shearable means for securing said valve sleeve in said run-in position.

8. The apparatus of claim 6 further comprising unidirectional ratcheting means for preventing return movement of said valve sleeve from said first and second positions.

9. The apparatus of claim 6 wherein said means responsive to fluid pressure in said mandrel bore comprises a fluid pressure chamber defined between said valve sleeve bore and the exterior of said mandrel; an internal piston shoulder in said valve sleeve bore; and a radial port in said hollow mandrel communicable with said fluid pressure chamber.

10. The apparatus of claim 9 further comprising internal sealing means in the bore of said inner tubular assembly isolating said mandrel radial port from said fluid pressure chamber in the said run-in position of the apparatus, whereby axial movement of said hollow mandrel from said run-in position is required to establish communication between said mandrel radial port and said fluid pressure chamber.

11. The apparatus of claim 8 wherein said unidirectional ratcheting means is operatively connected between said valve sleeve and said inner tubular assembly.

12. The apparatus of claim 11 wherein said unidirectional ratcheting means comprises wicker threads on the exterior of said inner tubular assembly; a collet secured to said valve sleeve; said collet having inwardly biased resilient arms engagable with said wicker threads.

13. The apparatus of claim 1 further comprising a bushing secured to the lower end of said outer tubular housing and having a bore sealably engaging said hollow mandrel to seal the bottom end of said sampling chamber; a fluid withdrawal passage in said bushing; and a manually operable, normally closed valve in said withdrawal passage.

14. The apparatus of claim 13 further comprising means on the outer end of said withdrawal passage for sealably engaging the neck of a fluid sample container, whereby virgin fluid from the selected formation is transferred without contamination to the fluid sample container.

15. The apparatus of claim 6 further comprising a bushing secured to the lower end of said outer tubular housing and having a bore sealably engaging said hollow mandrel to seal the bottom end of said sampling chamber; a fluid withdrawal passage in said bushing; and a manually operable, normally closed valve in said withdrawal passage.

16. The apparatus of claim 15 further comprising means on the outer end of said withdrawal passage for sealably engaging the neck of a fluid sample container, whereby virgin fluid from the selected formation is transmitted without contamination to the fluid sample container.

* * * * *